United States Patent [19]

Bekefi et al.

[11] 4,200,821

[45] Apr. 29, 1980

[54] RELATIVISTIC ELECTRON BEAM CROSSED-FIELD DEVICE

[75] Inventors: George Bekefi, Brookline, Mass.; Thaddeus J. Orzechowski, Livermore, Calif.

[73] Assignee: Massachusetts Institute of Technology, Cambridge, Mass.

[21] Appl. No.: 778,392

[22] Filed: Mar. 17, 1977

[51] Int. Cl.[2] ..... H01J 25/50

[52] U.S. Cl. ..... 315/39.51; 315/3.5; 315/5; 315/4; 313/336

[58] Field of Search ..... 315/3.5, 5, 4, 39.51; 313/336

[56] References Cited

U.S. PATENT DOCUMENTS

| | | | |
|---|---|---|---|
| 3,457,450 | 7/1969 | Feinstein et al. | 315/5 |
| 3,489,944 | 1/1970 | Denholm et al. | 313/336 |
| 3,700,945 | 10/1972 | Friedlander et al. | 315/3.5 |
| 3,916,239 | 10/1975 | Friedlander | 315/3.5 |
| 3,919,580 | 11/1975 | Mooney et al. | 313/336 |
| 4,028,583 | 6/1977 | Bigham | 315/39.53 |

*Primary Examiner*—Saxfield Chatmon, Jr.

*Attorney, Agent, or Firm*—Arthur A. Smith, Jr.; Robert Shaw

[57] ABSTRACT

An intense relativistic crossed field device in a nested configuration wherein a field emission cathode is nested within a segmented annular anode with an annular gap separating the two.

10 Claims, 5 Drawing Figures

IA
IA1
IA2

104
ELECTRIC POWER SUPPLY
TO SOLENOID
G
101
2
3
15
4
4A
TO CATHODE 1
HIGH VOLTAGE SUPPLY
1
Bz
4
4B
10
102
7
2
8

RELATIVISTIC ELECTRON BEAM CROSSED-FIELD DEVICE

The government has rights in this invention pursuant to Contract E(11-1)2766 awarded by the Energy Research and Development Administration and Contract No. ENG 75-06242-1401 awarded under Institutional Patent Agreement No. 0010 awarded by the National Science Foundation.

The present invention relates to crossed field devices such as, for example, magnetrons that generate microwave energy. These devices are characterized by the fact that electrons move in crossed electric and magnetic fields.

There accompany herewith a copy of a journal article entitled "Giant Microwave Bursts Emitted from A Field-Emission, Relativistic-Electron-Beam Magnetron" of the present inventors, Phys. Rev. Lett., Vol. 37, No. 6, pp. 379–381 (the journal article is hereby incorporated herein by reference) and commentary entitled "Electron beams yield high-power microwaves", *Physics Today*, Nov., 1976, pp. 18–20.

Microwave energy finds widespread usage in communications (e.g., interplanetary communications), in spectroscopy, in thermonuclear fusion reactors and in general physics. It is an object of the present invention to provide a magnetron that produces such microwave energy at power levels far higher than heretofore available.

Another object is to provide a novel crossed-field device of more general nature.

Still another object is to provide a system that includes such crossed-field device.

These and still further objects are addressed hereinafter.

The foregoing objects are achieved in a relativistic electron beam, crossed-field device having a field emission cathode and an anode separated therefrom by a vacuum region. The anode also serves as a slow wave electromagnetic structure. Means is provided to produce a magnetic field in the vacuum region so as to direct electrons along a predetermined path along the slow-wave structure and thereby produce electromagnetic wave energy within the slow-wave structure. In preferred form, the device is a magnetron in the form of a nested structure having an internal cylindrical cathode, an annular vacuum gap that extends outward from the circumferential or curved surface of the cylindrical cathode and an anode that comprises circumferentially spaced, radially oriented cavities distributed along a circular path across the gap from the cathode. An operating system further includes a high voltage power source connected to provide a very high electric field in said gap to extract electrons from the cathode. In the nested configuration, the electrons move along a circumferentially directed path. Other related crossed-field devices are, for example, the inverted magnetron (i.e., a magnetron with its cathode on the outside and its anode, with resonant cavity, on the inside), the monotron, the amplitron and the carcinotron.

The invention is hereinafter described with reference to the accompanying drawings in which.

Crossed-field devices embodying the concepts herein disclosed need not be magnetrons (the invention also has use in conjunction with inverted magnetrons, monotrons, amplitrons and carcinotrons, for example) but the device herein described in greatest detail is a magnetron and is, in fact, the magnetron discussed in said journal article which is drawn upon heavily for this specification. In the discussion that now follows, the system is described briefly to provide a basis for the more detailed explanation later.

Figure 2:
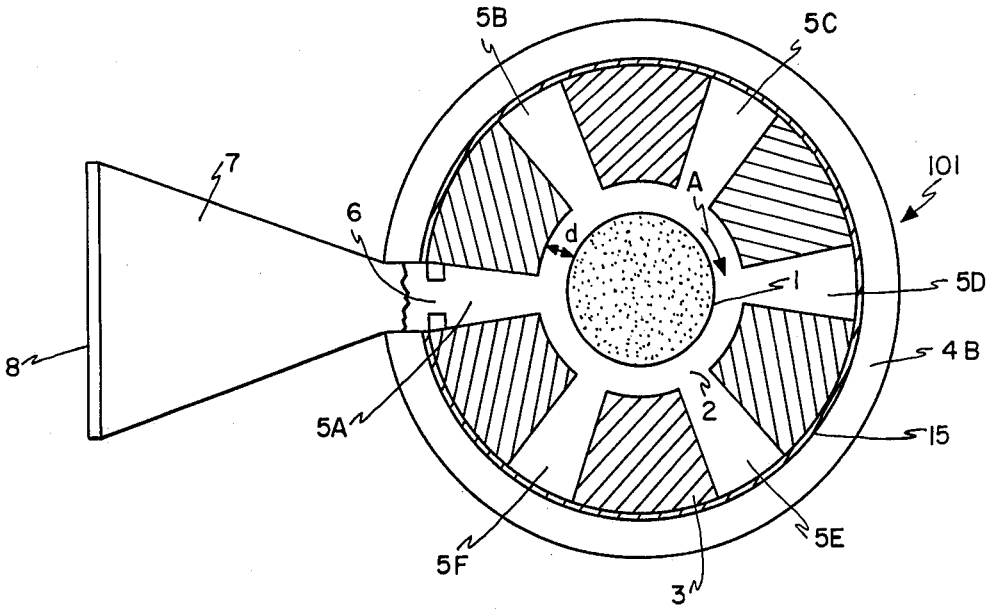
FIG. 2 is a reduced-size, section view taken upon the line 2—2 in FIG. 1 and looking in the direction of the arrows.
Figure 3:
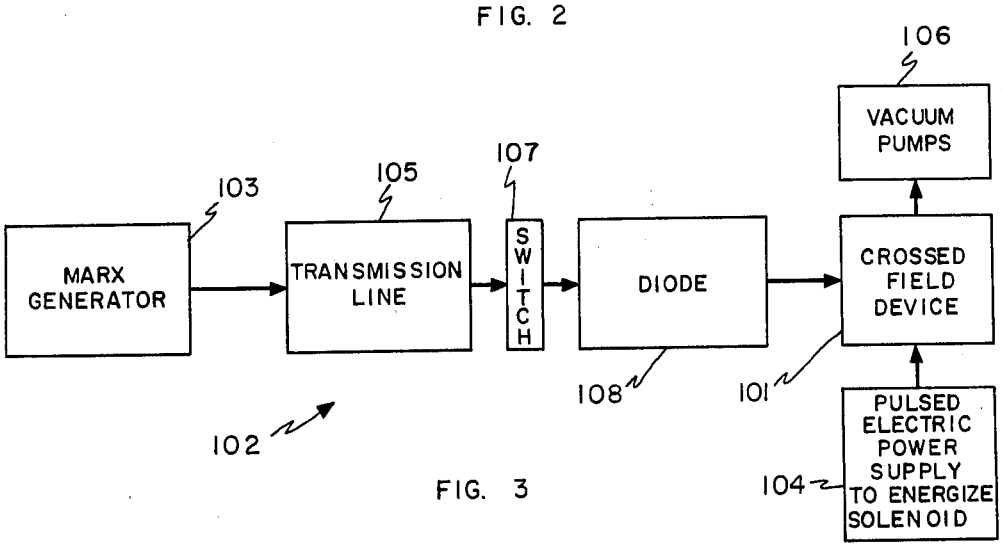
FIG. 3 is a diagrammatic representation of a system that includes apparatus like that shown in FIG. 1 plus additional system elements.

The system shown at 102 in FIG. 3 includes a crossed-field device 101, a high voltage supply 103 and pulsed electric power supply 104. The crossed-field device 101 may be the magnetron shown at 101 in FIGS. 1 and 2, which is a nested configuration comprising a cylindrical cathode 1 and an anode 3 spaced radially outward from the cathode, there being an annular gap 2 between the anode and the cathode. The anode and cathode are located within a vacuum enclosure 15 having a cap 10 to seal the end thereof. The cylindrical cathode 1 is the central member of the device 101 and the cathode axis coincides with the axis of the device 101. A solenoid 4 (actually a pair of coils 4A and 4B act as a single solenoid in a device built and later discussed; the coils 4A and 4B slip over respective ends of the metal vacuum enclosure 15) is energized by the electric power supply 104 to provide an axial magnetic field of nearly uniform intensity in the gap 2 except that the intensity of the field (which is labeled $B_z$) is higher at the two axial ends of the gap 2 to provide a magnetic mirror effect.

In an operating system, a high voltage (300 kv to a few MV) is applied radially across the gap 2, that is, across the d dimension in FIG. 2. With a sufficiently high electric field in the gap, electrons are extracted from the field emission cathode 1 and into the gap 2 wheren interaction with the axial magnetic field $B_z$ cause them to move in a circumferential direction along a circular path, as indicated by the arrow shown at A. The anode 3 is in the form of a slow-wave structure comprising a plurality of, circumferentially spaced, radially oriented cavities or vane-type structural resonators 5A-5F. One of the cavities, the cavity 5A, is provided with an iris 6 through which radiant energy is coupled into a microwave horn 7 and then out as later discussed, but other well-known ways of coupling out the energy can be employed.

In the magnetron 101, the high pulsed voltage between the anode and the cathode serves to extract electrons from the cathode and form a very dense space charge cloud of electrons near the cathode in the annular gap 2; the electrons drift along an approximate circular, closed path, as mentioned, under the simultaneous action of the radial electric field and the axially directed magnetic field $B_z$ which is, thus, orthogonal to the electric field. Due to interaction between the circumferentially directed electrons and the cavities 5A . . . of the slow wave structure, the electron flow forms spokes that rotate around the cathode 1. The azimuthally rotating, bunched electrons act to induce electromagnetic fields in the cavities 5A-5F; the radiation, thus formed, in the cavity 5A is coupled via the iris 6 from the magnetron cavity as above noted. In the system discussed in the next few paragraphs, a magnetron built and tested at MIT yielded power of 1.7 gigawatts; the efficiency of converting electron beam to microwave energy in the magnetron was close to thirty-five percent.

Figures 1, 5:
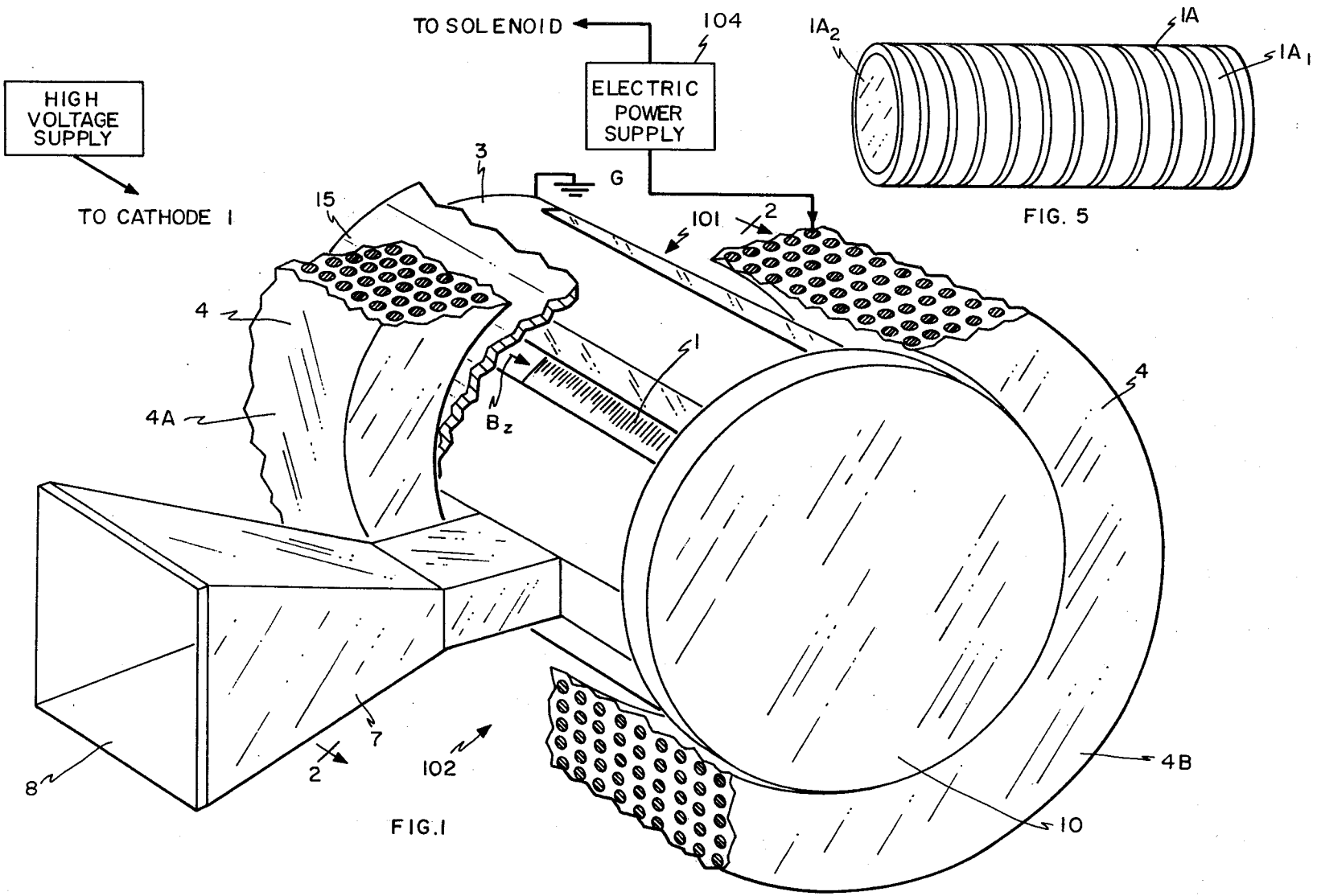
FIG. 1 shows, partly diagrammatic in form, apparatus embodying the present inventive concepts, said apparatus including a magnetron which is shown in an isometric view, partly cutaway, and including a field emitting cathode.
FIG. 5 is an isometric view of a modification of the field emitting cathode of FIG. 1.

The schematically shown cylindrical vacuum diode 101 in FIG. 1, actually built, has an aluminum anode block 3 (an oxygen-free copper anode was also built and tested) with an inner radius of 2.1 cm; it is 9.4 cm long. Cut within the block 3 are the six vane-type resonators 5A-5F tuned to oscillate at a frequency of 3.0 GHz. Each resonator is 7.2 cm long; one of the resonators, the resonator 5A as previously mentioned, is provided with the iris 6 through which the radiant energy is coupled into the microwave horn 7, via a section of flared, S-band waveguide. The horn 7 is 43 cm long and has a rectangular aperture 8 which is 17 cm wide in the E-plane and 23 cm wide in the H-plane. The inner coaxial cathode cylinder 1 is machined from dense fine-grained, graphite; it is 4.8 cm long and 1.58 cm in radius. Cathodes with radii up to 1.76 cm have also been tried, but their use led to less microwave emission. The cathode 1 is connected via a stainless steel shank to the inner conductor of a water-filled coaxial capacitor 105 in FIGS. 3 and 4, which serves as the transmission line of the 4Ω Nereus high voltage facility (maximum voltage ≈600 kV) energized by the Marx generator 103 in FIG. 3. The anode 3 is connected to the grounded wall marked 105C of the capacitor 105. The entire system, including the transmitting horn 7, is continuously pumped to the pressures better than $10^{-4}$ Torr by a vacuum pump 106 in FIG. 3.

The axial magnetic field $B_z$ acting on the diode is, in fact, and as above indicated generated by the solenoid 4 comprising the two coils 4A and 4B mounted in an approximate Helmholz-pair configuration around the casing 15. The magnetic field is nearly uniform over the entire length of the cathode cylinder. However, provision is made for a slight rise in the magnetic field at the two ends of the cathode. The resulting "magnetic mirror" arrangement is probably beneficial in stabilizing the axially rotating electron space charge cloud of the magnetron 101. The solenoid coils are energized by a capacitor bank whose rise time is −6 millisec. The discharging of this bank is timed in such a way that $B_z$ reaches its peak value when Nereus (i.e., the Marx generator or other high voltage power supply 103) fires. Thus, the magnetic field is virtually constant in time over the duration of the ≈35 nsec voltage pulse applied across the diode. The aluminum anode block 3 is not solid but, in addition to the six resonators 5A . . . , it is pierced with several large vacuum holes (not shown) whose purpose is to reduce the amount of metal through which the magnetic field must diffuse. The ensuing "thin-walled" construction of the anode block ensures good penetration of the pulsed magnetic field into the diode interior. A magnetic field as high as 16 kG can be generated; its strength is controlled by the charging voltage on the capacitor bank. The solenoid current is monitored by means of a precision current probe which, after calibration, yields values of $B_z$ with an accuracy of ~5%.

There is a discussion in said paper, which need not be repeated here, of techniques for measuring power outputs and other important operating conditions of the system 102. From the measurement thus made, some important aspects of the magnetron tested were noted.

When the axial magnetic field $B_z$ is zero, the magnetron current is typically 35 kA and V ≈260 KV giving a diode impedance equal to 7.4Ω. As $B_z$ increases from zero, a critical magnetic field $B_z = B^*$ is reached at which point the diode is said to be magnetically insulated, and ideally, no current should flow across the diode. For voltages, geometry and gap spacings of the diode 101 discussed in said paper (d=5.2 mm), $B^* = 4800$ G. That substantial current does flow in the forbidden regime, $B_z \geqq B^*$, represents one of the classical properties of all magnetrons. It signifies that "non-conservative" oscillatory processes must, in fact, be occurring. Thus, strong onset of microwave emission is expected to occur at this critical magnetic field. As $B_z$ is increased beyond $B^*$, the diode current keeps falling, and the diode voltage increases slightly. These trends are manifestations of the fact that, with increasing magnetic field the diode impedance increases and becomes more and more mismatched relative to the 4Ω nominal impedance of the Nereus generator 103. In order to improve efficiency, care must be given to matching impedance of the magnetron with that of the generator.

In the cutoff regime ($B_z > B^*$), an equilibrium, azimuthally rotating could is established characterized by a radially dependent drift $\vec{v}_c(r) = \vec{E}(r) \times \vec{B}/B^2$. The six equally spaced microwave cavities cut in the anode block act as a slow wave structure; they permit the establishment of a wave whose phase velocity $v_p$ approximately equals the drift velocity $v_d(r)$ of a "resonant" electron layer. Under these conditions efficient transfer of energy from the beam to the wave can occur. It is clear that for a fixed diode geometry and for a fixed diode voltage V, the magnetron can oscillate only over a limited regime of magnetic fields. The minimum field is $B_{min} = B^* \approx 4800$ G. The maximum field $B_{max}$ is determined approximately by the drift velocity $v_c$ of the fastest (outermost) electron layer. Using the theory developed by others, it is found that for the tested magnetron $B_{max} \approx 1.75\ B^* = 8400$ G, significant microwave emission is indeed limited to a rather narrow range of magnetic fields whose magnitudes are in good accord with theory. The peak emission reaches a value of 1.7 GW. The peak conversion efficiency equals nearly 35%, as above noted. The magnetron was tested in the VEBA facility at NRL at a voltage of 750 kV and yielded 4 GW at 30% efficiency.

Figure 4:
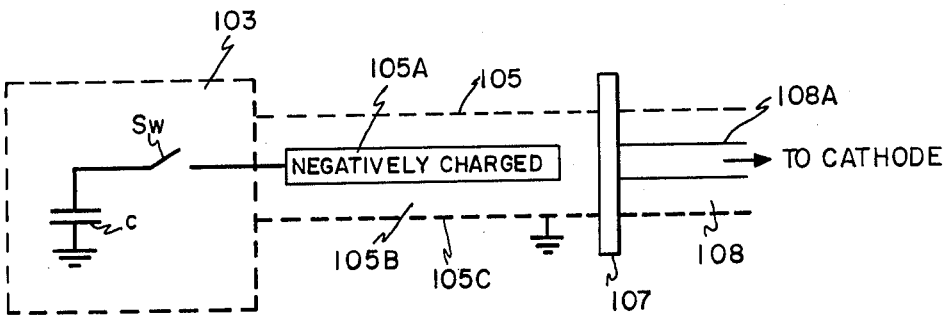
FIG. 4 shows diagrammatically a portion of the system of FIG. 3.

A few matters of a general nature are taken up in this paragraph. The high voltage power supply 103 can be a Marx generator, a Van De Graaf generator or other supply, all of which are known to workers in the art. In FIG. 4 the supply 103 is shown comprising a capacitance C and switch $S_W$. The transmission line 105 consists of a cylindrical conductor 105A surrounded by a water jacket 105B. The system 102 of FIG. 3 further includes a switch 107 and diode 108. In the actual system discussed in said journal article, the switch 107 is a polethylene sheet which must be replaced after each operation of the system, and the diode 108 is an evacuated coaxial system consisting of an outer cylinder and a central electrode 8A held in place by a series of high-voltage insulating rings (not shown).

The cathode 1 in FIGS. 1 and 2 is in the form of a solid elongate cylinder of carbon. The cathode shown at 1A in FIG. 5 is a cylindrical spiral structure (comprising a carbon spiral winding $1A_1$ would about a dielectric core $1A_2$) which seems to reduce the self-magnetic field generated by current flow in the cathode itself; such self-generated magnetic field tends to lead to a very complicated space charge flow in the device and can be a problem, particularly at higher and higher electric current. Although carbon was used at the cathode material in the system built, other materials such as stainless steel, for example, can be used as well as semiconductor materials and other conducting materials.

As is indicated above, the cross-field device of greatest interest here is the magnetron 101 in FIG. 1, but other crossed-field devices can be used at 101 in the system 102 of FIG. 3; thus, for example, in such other devices the electrons can be injected into the interaction region from a cathode (i.e., the electron-emitting surface or element) that is physically separated from the slow wave structure. Such devices include the monotron, the amplitron, the carcinotron, all having field emission cathodes of the type herein disclosed. Also, it will be appreciated by workers in the art that radiation can be withdrawn in a number of different ways other than by the single horn 7.

Modifications of the invention herein disclosed will occur to persons skilled in the art and all such modifications are deemed to be within the spirit and the scope of the invention as defined by the appended claims.

What is claimed is:

1. An intense relativistic electron crossed-field magnetron device that comprises, in combination: a cylindrical field emission cathode capable of providing extremely high electron current densities; an anode which also serves as a slow wave structure, said anode comprising a plurality of axially-symmetric, periodic, circumferentially-spaced cavities distributed along a circular path, said cavities serving to bunch electrons in the form of spokes that rotate around the axis of symmetry in an operating device, the rotating bunched electrons acting to induce electromagnetic fields in the cavities; means to create a magnetic field in the region between the cathode and the anode; and means to couple out electromagnetic radiation from the cavities.

2. An intense relativistic-electron crossed-beam device as claimed in claim 1 in which the device is a magnetron in the form of a nested structure with the cathode being the central or inner member of the structure and the anode being the outer member thereof, the cathode and the anode being separated by a vacuum gap from one another, and in which the slow wave structure comprises a plurality of outwardly extending cavities distributed along the gap, said cavities, in an operating device, serving to bunch electrons which rotate azimuthally around the cathode.

3. An intense relativistic electron crossed-beam device as claimed in claim 3 in which the cathode is a cylindrically shaped member, in which the gap is an annularly shaped space about the cathode, and in which the cavities are distributed uniformly along a circular path about the axis of the cylinder and extend radially outward.

4. A system that includes a crossed-beam device as claimed in claim 3 and that further includes high voltage source means connected between the cathode and the anode to extract electrons from the cathode and form a very dense space charge cloud of such electrons near the cathode, the magnetic field being an axial magnetic field which causes the electrons to circulate in a closed-loop path in the vacuum gap around the cylindrical cathode, said cavities serving to bunch the electrons as they move in the closed-loop path, the bunched, moving electrons acting to induce electromagnetic fields in the cavities, one of the cavities having an iris to permit the electromagnetic fields to escape as radiation from such cavity.

5. A system as claimed in claim 4 that further includes means to evacuate the spaces in said gap and in said cavities to form a vacuum therein, the gap and the cavities acting in combination to form a resonant cavity for the electrons.

6. An intense relativistic-electron crossed-field device as claimed in claim 1 in which the device is a magnetron in the form of a nested structure wherein the cathode is graphite or other good field emission material and the central or inner member of the structure and the anode is the outer member thereof, the cathode and the anode being separated from one another by an annular vacuum gap, the electric current being electrons that emit from the cathode and move in a circumferential direction within the annular gap by virtue of the effect of the crossed-electric and magnetic fields, and in which the slow wave structure that forms part of the anode comprises a plurality of cavities distributed along the periphery of the annular gap, said cavities, in an operating device, serving to bunch electrons in the form of spokes that move in a circumferential direction within the annular gap.

7. A device as claimed in claim 6 wherein the cathode is cylindrical.

8. A device as claimed in claim 1 wherein the cathode is in the form of a cylindrical spiral.

9. A device as claimed in claim 1 wherein the cathode is in the form of a solid cylinder.

10. An intense relativistic electron beam crossed-field magnetron device that comprises, in combination: a cylindrical field emission cathode capable of providing extremely high current densities of the order of kiloamperes per square centimenter; an anode which also serves as a slow wave structure, and anode being separated from the cathode by a vacuum region, said anode comprising a plurality of periodic, circumferentially spaced, radially oriented cavities distributed along a circular path; and means for creating a magnetic field in the region between the cathode and the anode, the magnetic field in said region having a component that is orthogonal to a component of the electric field between the anode and the cathode in an operating system.

* * * * *